United States Patent [19]

Lenander

[11] Patent Number: 4,474,280

[45] Date of Patent: Oct. 2, 1984

[54] COIN-OPERATED LOCK FOR A TROLLEY SYSTEM INCLUDING ESPECIALLY SHOPPING AND LUGGAGE TROLLEYS

[75] Inventor: Aage Lenander, Rungsted Kyst, Denmark

[73] Assignee: CATENA-Locks A/S, Denmark

[21] Appl. No.: 403,654

[22] PCT Filed: Nov. 30, 1981

[86] PCT No.: PCT/DK81/00107

§ 371 Date: Jul. 15, 1982

§ 102(e) Date: Jul. 15, 1982

[87] PCT Pub. No.: WO82/01950

PCT Pub. Date: Jun. 10, 1982

[30] Foreign Application Priority Data

Nov. 28, 1980 [DK] Denmark ..... 5091

[51] Int. Cl.[3] ..... G07F 5/02

[52] U.S. Cl. ..... 194/93; 194/1 E

[58] Field of Search ..... 194/4 D, 4 G, 4 R, 55, 194/2, 1 A, 1 R, 64, 1 E, 4 E, 4 C, 54, 93

[56] References Cited

U.S. PATENT DOCUMENTS 3,197,008 7/1965 Moore ..... 194/64

*Primary Examiner*—Stanley H. Tollberg

*Attorney, Agent, or Firm*—Silverman, Cass & Singer

[57] ABSTRACT

A coin-operated lock for mounting on a trolley which is alternatively secured and released. The lock has two blockable keyholes for two separate keys, and a common fence which cooperates with the keyholes is adapted to move from a blocking position in one of the keyholes to a blocking position in the other keyhole upon insertion of a key into the latter keyhole, for securing one of the keys inserted into the corresponding keyhole.

9 Claims, 14 Drawing Figures

Figure 1:
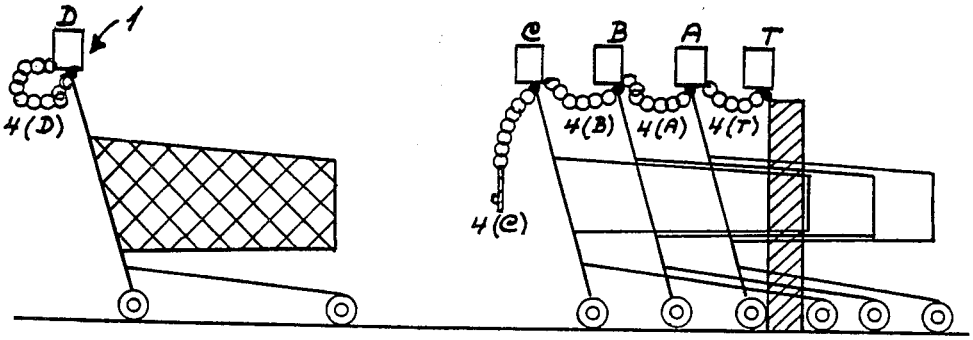

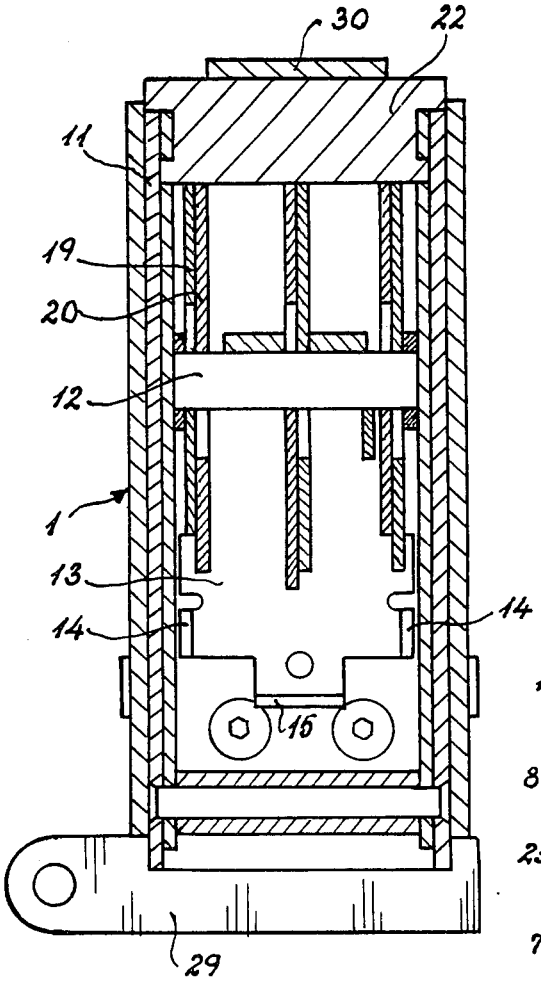
Fig. 4
Fig. 5
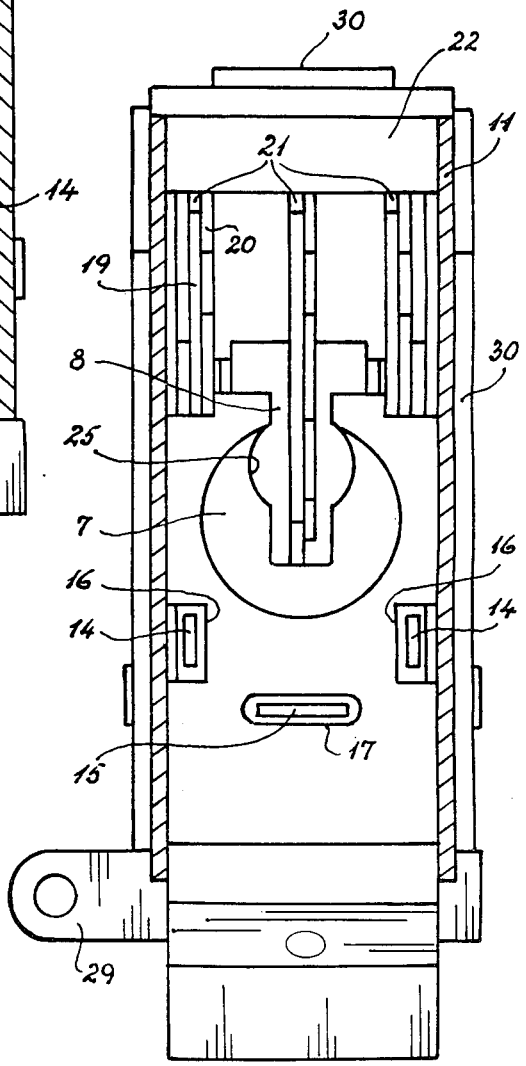

COIN-OPERATED LOCK FOR A TROLLEY SYSTEM INCLUDING ESPECIALLY SHOPPING AND LUGGAGE TROLLEYS

The invention relates to a coin-operated lock adapted for installation on a trolley being part of a system of such trolleys, especially shopping and luggage trolleys. The coin-operated lock is arranged for release of a secured trolley by insertion of a coin, and for repayment of the amount deposited when the trolley is returned, the lock having two blockable keyholes for accepting separate keys, one of which is anchored to the trolley on which the lock is mounted. The lock is further arranged so that when a coin is inserted, one keyhole is released for accepting and securing the said key anchored to the same trolley, so that the other keyhole secures a key belonging to another trolley or a coupling unit, so that the other keyhole—when the said key anchored to the same trolley is inserted in the former keyhole—is released for release of the other key, and so that the former keyhole is released for release of the said key secured therein and anchored to the same trolley, and for repayment of the coin when the other key is inserted in the other keyhole.

Release and anchoring of the trolley is thus done by simple insertion and withdrawal of a key into and from a keyhole. The keys are suitably fixed to the trolleys by a chain. Interlocking of trolleys is not dependent on their completely correct alignment mutually or with the coupling unit.

The key system also permits a special simple embodiment since at any rate the keys belonging to the trolleys can be arranged as a carrier for the coin, and the said former keyhole can be arranged for only accepting a key carrying a coin. It means that payment and insertion of the key belonging to the same trolley can be combined.

The object of the invention is to show how the coin-operated lock can be designed as a construction which is not only simple to operate, but which is also of a simple and robust design and thus suitable as a unit which can be designed in a space saving manner which can be fixed to the trolley easily, and which can give satisfactory operation even if it is operated by little trained persons.

This object is, according to the invention, achieved by each keyhole having a tumbler arranged for securing a fence in a blocking position in one of the keyholes for securing a key inserted therein, and by the fence being movable from this blocking position to a blocking position in the other keyhole by means of abutment units which from the fence project into separate keyholes and which are adapted for actuation by a key which is inserted into the relevant keyhole.

It means that there is a common fence for both keyholes which can be moved to and secured in each blocking position by separate keys and tumblers since the fence function is controlled by the interaction between the requisite keys for operation of the lock. The locking mechanism can be given a robust construction because it has but few parts which are to be moved. The possibility of arranging the coin-operated lock for operation by keys, one of which is constructed as a carrier for a coin, can according to the invention be satisfied in a simple way by one of the tumblers being arranged only for interaction with a key carrying coin. Besides, the principle of a common fence permits a space saving construction as according to the invention the keyholes can be designed as two slotted channels positioned opposite and parallel to each other and are arranged for acceptance of keys designed for insertion, and that the stops project into their separate channels.

A simple embodiment of the coin-operated lock can also, according to the invention, be that the fence is made as a swingable unit, the axis of rotation of which lying between the planes of the keyholes and parallel to these, the fence at its free end remote from said axis being provided with opposite projecting securing projections which, depending on the position of the fence, are arranged for a securing mesh with separate keys.

According to the invention the tumblers can be arranged for both a springy securing effect on the keys in a direction opposite to their direction of insertion, and for fixed securing of the keys in a direction transverse of their direction of insertion. Besides positive guidance of the tumblers, the spring force can be utilized for ejection of a key when it is released by insertion of another key, and the blocking transverse of the insertion direction of the keys ensures that the key inserted into the lock is secured in the blocking position even if the trolley is subjected to shocks during travel.

Besides, a simple and space saving embodiment of the coin-operated lock can, according to the invention, also consist in the fence being made as a double-walled body, either side wall of the body facing its own slot-shaped channel, that the walls are interspaced, and that the fence and tumblers are arranged so that the tumblers in blocking position bear against the inner side of the side wall, the outside of which faces a blocked keyhole.

Figure 2:
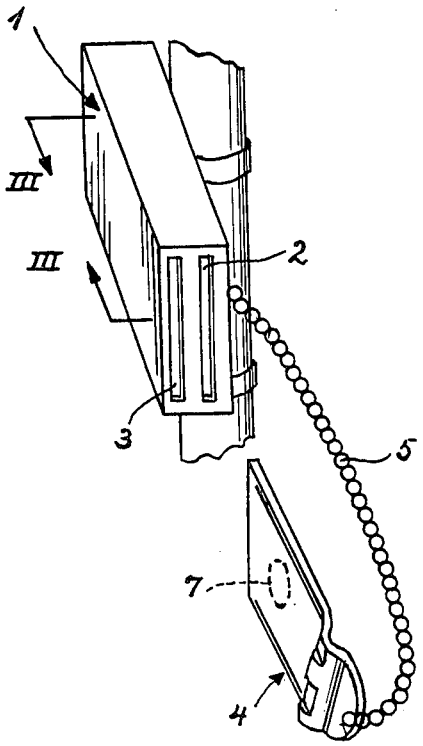
Figure 3:
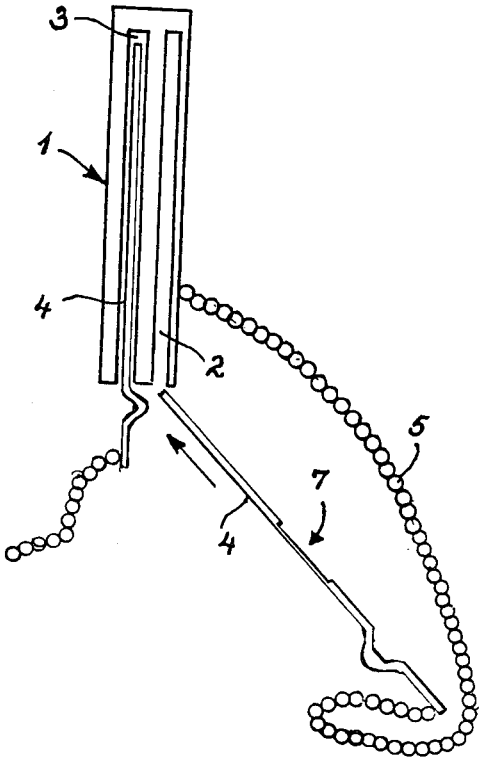
Figure 6:
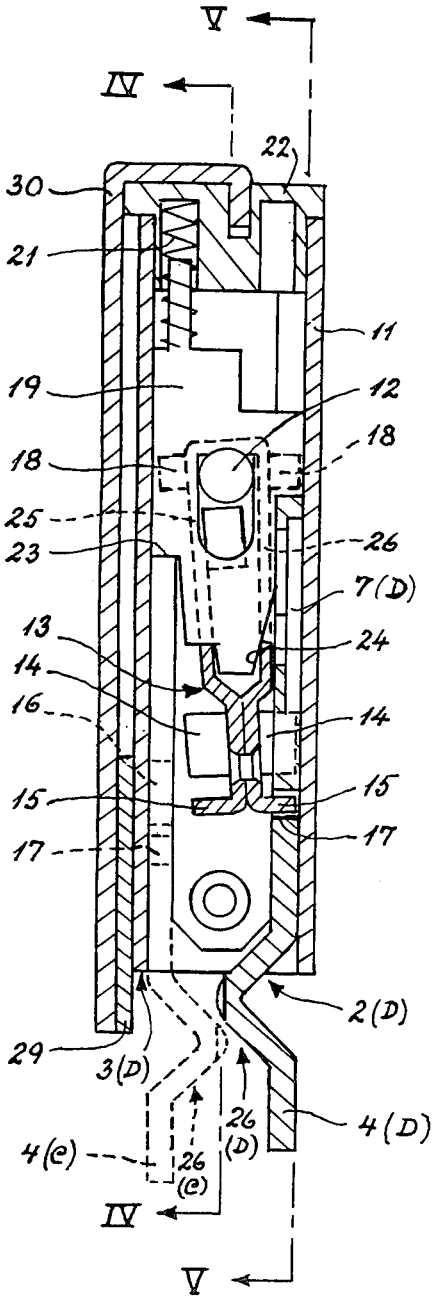
Figure 7:
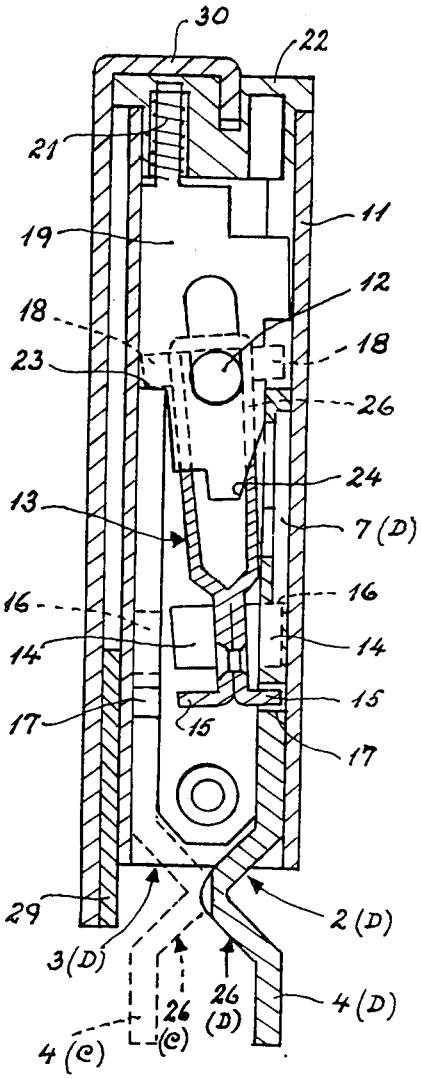
Figure 8:
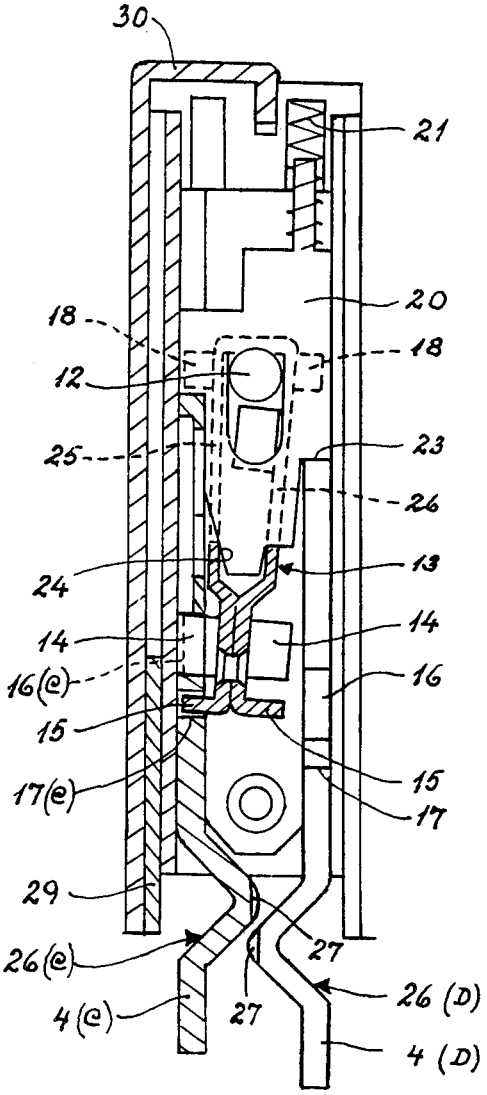

In what follows, the invention will be explained in detail with reference to the drawing in which Fig. 1 shows an arrangement of four shopping trolleys, each provided with an embodiment of the coin-operated lock according to the invention, so that two of the trolleys are mutually anchored, the third trolley is anchored to a coupling unit, and the fourth trolley is released, Fig. 2 on a larger scale is an oblique picture seen from below this lock, FIG. 3 is a schematic representation through the lock along line III—III in FIG. 2, with a key inserted in the lock and a key about to be inserted into the lock, FIG. 4 shows an embodiment of a coin-operated lock according to the invention, along line IV—IV in FIG. 6, FIG. 5 is the same embodiment with the key inserted, along line V—V in FIG. 6, FIG. 6 is the same embodiment in cross section in blocking position to the right of an inserted key, while the other key is inserted in the left-hand side of the lock, FIG. 7 is the same embodiment with the key inserted in the left-hand side immediately before release of the lock fence for securing the left-hand key and release of the right-hand key, FIG. 8 is the same embodiment with the left-hand key secured and the right-hand key released, and FIGS. 9–14 are schematic representations of the coin-operated lock with keys in different positions of function.

FIG. 1 shows an arrangement of four trolleys, A, B, C and D. Of these four trolleys, A is anchored to a coupling unit T, e.g. in the form of a stanchion or a wall. The trolley B is anchored to trolley A, trolley C is anchored to trolley B, and trolley D is released from its anchoring to trolley C.

Each of the trolleys A–D has a coin-operated lock in a box-shaped housing 1, at one end of which there are two keyholes 2 and 3. A key 4 belongs to the coin-operated lock and can be inserted and secured in keyhole 2. This key 4 is fixed through chain 5 to the housing 1 or the trolley to which the housing is fixed. In the present embodiment the key 4 is also designed as a carrier for a coin since it has a recess 7 corresponding to the coin.

The key 4 is shaped as a tongue for insertion, at the insertion end of which there is a recess 8 with access from the outside. This recess extends into the key through the bottom of recess 7. In the embodiment shown in FIG. 5 the recess spans diametrically over a major portion of this bottom. However, it may also be somewhat shorter or longer so that it reaches only some distance into the bottom or some distance past the bottom.

In the embodiment shown the housing 11 of the coin-operated lock is designed as an oblong, upright box of rectangular cross section. Keyholes 2 and 3 open into the bottom of the housing and have the shape of slotted channels for accepting keys shaped as flat tongue-shaped units for insertion. A fence 13 which can turn freely on a cross pin 12 is mounted in the housing 11. The pin 12 extends between the planes of keyholes 2 and 3 and parallel to these. At the end facing away from the pin the fence 13 has, at either side, two fixing projections 14 projecting opposite to each other in the turning plane, and at its lower edge it has two fixing projections 15 projecting opposite to each other in the turning plane. The keys 4 have side notches 16 corresponding to the projections 14, and a corresponding slot 17 with which the projections 15 can mesh when the keys are inserted in housing 11. Furthermore, fence 13 is provided with two stops 18 in the form of projections projecting opposite to each other in the turning plane. These stops project from the fence to either side of pin 12 and into keyhole-channels 2 and 3.

Besides, the housing contains three tumblers displaceable in the longitudinal direction of the housing and each consisting of two tumbler units 19 and 20 mounted parallel to each other. Each unit 19 and 20 is actuated by a compression spring 21 located between the upper end of the unit and the top plate 22 of the housing. The two units of each tumbler are designed for interaction with their separate keyhole-channel. For this purpose, either unit has partly an abutment face 23 for the key inserted in the channel concerned, partly a contact face 24 turning sideways by means of which the unit can keep the fence 12 in contact with a key inserted in the housing.

Besides, the fence 13 is constructed as a double-walled unit whose two side walls 25 and 26 face their separate keyhole-channels 2 and 3, respectively, and fence 13 and tumbler units 19 and 20 are arranged so that a tumbler unit in a blocking position of the fence bears against the inner side of the side wall, the outer side of which faces a keyhole-channel which is blocked.

The lock works in the following way:

The situation shown in FIG. 6 is taken as starting position. In this example a key 4(D), which is assumed to hold a coin in its recess 7(D), is secured to housing 11 in keyhole-channel 2(D).

The fence 13 is swung to the right so that the right-hand securing projections 14 and 15 engage notch 16 and slot 17 of the key. A tumbler unit 19, the abutment face 23 of which projects into keyhole-channel 3(D), contacts the inner side of the fence wall 26 via its contact face 24 and thus secures the mesh of projections 14 and 15 with recesses 16 and 17.

Another key 4(C) is inserted some distance into keyhole-channel 3(D) up to abutment face 23 of tumbler unit 19. A continued insertion of key 4(C) pushes tumbler unit 19 upwards so that spring 21 is compressed and the contact face 24 is pulled away from its contact position with the inner side of wall 26 and opposite to a slot located in this wall and shown in dotted lines in the drawing, and the key 4(C) begins to tread on the stop unit 18 of the fence 13, which unit projects into keyhole-channel 3(D). See FIG. 7. Further insertion of key 4(C) swings the fence to the left so that the mesh connection between fence 13 and key 4(D) is released, while the fence then, via its projections 14 and 15 turning to the left, engages with recesses 16(C) and 17(C) of key 4(C). The other tumbler unit 20 is then ready for making a switch-over from the position shown in FIG. 8 to the position shown in FIG. 6, cf. FIG. 8.

Key 4(C) carries no coin, and the centre tumbler, which is opposite to the coin slot 7, is somewhat longer than the other tumblers so that it can reach into a slotted axial recess in the bottom of slot 7. This arrangement has the effect that a key without a coin can only produce a release operation by insertion into the keyhole-channel which has a tumbler thus elongated.

In addition, both the keys 4(D) and 4(C) have a shoulder 26 and are arranged so that the shoulders of the keys face each other when inserted in housing 11. The shoulders are so high that they would collide and thus block their mutual passage if passage notches 27 and corresponding projections had not been made in the shoulders. By giving these notches, which are open in the direction of movement, and the projections different widths, measured in the transverse direction of the keys, the notches and projections can provide a code so that only keys adapted to each other can be used in the same housing. Hence it can be achieved that only trolleys which belong e.g. to the same enterprise can be coupled together.

A system of trolleys equipped with coin-operated locks according to the invention works in detail as follows:

When the rearmost trolley D of a row of trolleys A, B, C, D, which are anchored to the coupling unit T is to be released from the row, see FIG. 1, a coin 28 is to be inserted in the recess 7 of key 4(D) of trolley 4. The key 4(D) is then inserted into keyhole 2(D) of housing 1(D) fixed to trolley D. See FIGS. 9 and 10.

Figure 9:
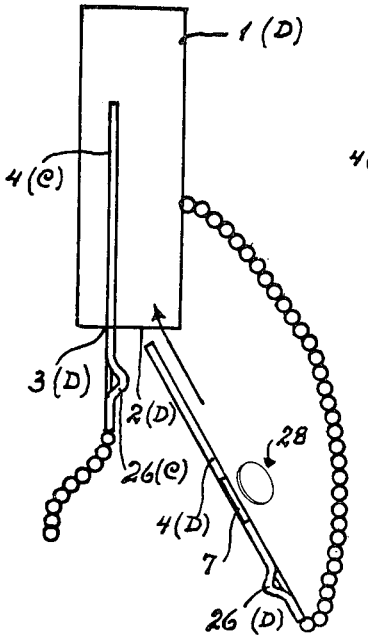
Figure 10:
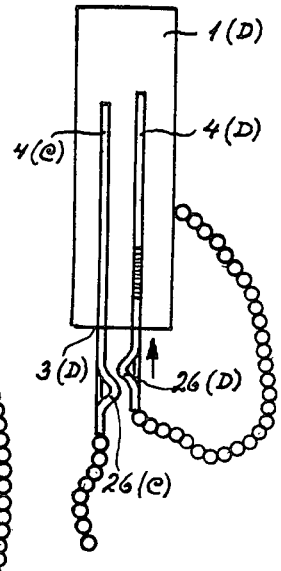
Figure 11:
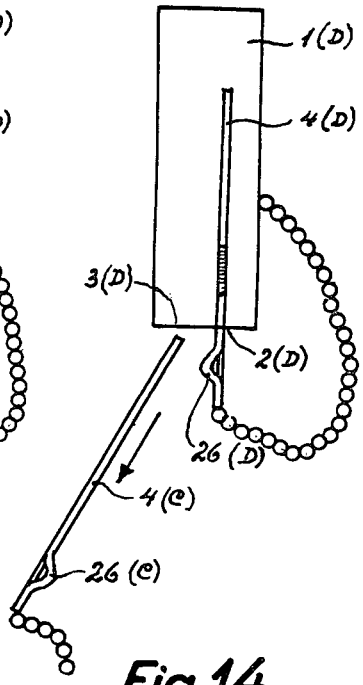

The key 4(D) belonging to trolley C is already anchored to this lock housing 1(D), see FIGS. 9 and 10, since it is inserted in keyhole 3(D) of housing 4(D) where it is secured by the fence of lock 1(D).

Both the keys 4(D) and 4(C) have shoulders 26 with corresponding code-forming projections and recesses, as described in the foregoing. Besides, the arrangement is such that the keys 4 can only be inserted in keyholes 2 and 3 with the shoulders 26 facing each other. See FIG. 10.

When key 4(D) is inserted so far into keyhole 2(D) that shoulder 26(D) of this key has passed shoulder 26(C) of key 4(C) secured in keyhole 3(D) in direction towards the lock housing, see FIG. 10, the fence of lock 1(D) is released by actuation partly directly by key 4(D), partly by the coin 28 inserted in key 4(D) so that the fence releases key 4(C) and secures key 4(D), cf. FIG. 10, whereupon key 4(C) can be removed from keyhole 3(D) of trolley D and trolley D is released, cf. FIG. 1. The trolley can then be moved around freely with its own key 4(D) and the coin inserted therein secured in housing 1(D).

Figure 12:
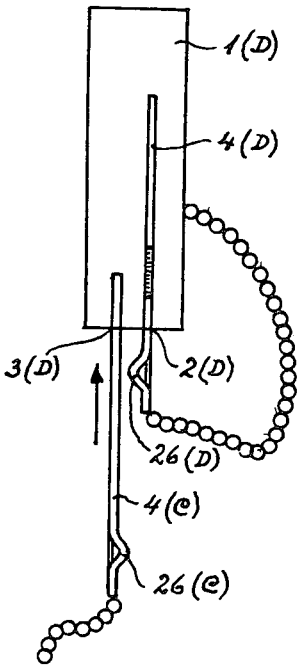
Figure 13:
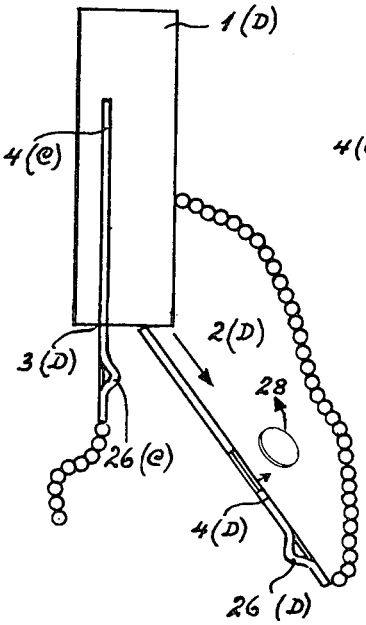
Figure 14:
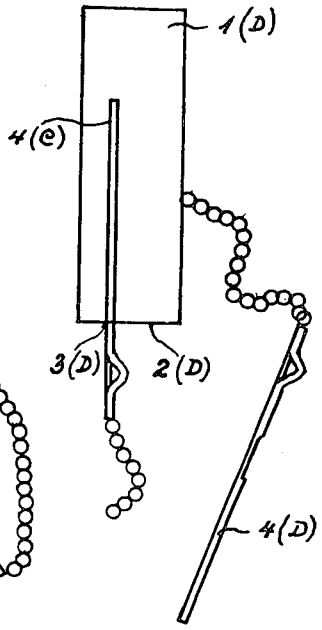

When the trolley D is returned to a row of trolleys or direct to coupling unit T, the key of the rearmost trolley of the row or of the coupling unit T, in the example shown in FIG. 1 the key 4(C) of trolley C, is re-inserted in keyhole 3(D) of trolley D, see FIG. 12, until shoulder 26(C) of key 4(C) has passed shoulder 26(D) of key 4(D) anchored in lock housing 1(D) which can be done freely since both shoulders 26(C) and 26(D) have corresponding blocking codes. The same conditions would exist for the keys 4 of the other trolleys of the same row as well as for the key of the coupling unit T. When key 4(C) has been inserted completely, it will actuate the fence of lock 1(D) so that it partly releases the key 4(D) of trolley D itself, partly detains key 4(C) of trolley C. See FIG. 13. Key 4(D) can be removed from lock housing 1(D), and the coin 28 can be removed from key 4(D) again. Trolley D is then coupled to the row of trolleys again and is ready for renewed hiring. See FIG. 14.

An anchor plate for the chain 5 connecting key 4(D) to housing 11 is denoted 29. 30 is a plate used for fixing housing 11 to a trolley.

I claim:

1. A coin-operated lock adapted for installation on a trolley being part of a system of such trolleys, especially shopping and luggage trolleys, said lock being arranged for release of a secured trolley by insertion of a coin, and for repayment of the amount deposited when the trolley is returned, the lock having two blockable keyholes for accepting separate keys, one of which being anchored to the trolley on which the lock is mounted, the lock being further arranged so that when a coin is inserted, one keyhole is released for accepting and securing the said key anchored to the same trolley, so that the other keyhole secures a key belonging to another trolley or a coupling unit, so that the other keyhole - when the said key anchored to the same trolley is inserted in the former keyhole - is released for release of the other key, and so that the former keyhole is released for release of the said key secured therein and anchored to the same trolley and for repayment of the coin when the other key is inserted in the other keyhole, characterized in that each keyhole has a tumbler arranged for securing a fence in a blocking position in one of the keyholes for securing a key inserted therein, and that the fence is movable from this blocking position to a blocking position in the other keyhole by means of abutment units which from the fence project into separate keyholes and which are adapted for actuation by a key which is inserted into the relevant keyhole.

2. A coin-operated lock as claimed in claim 1, characterized in that the keyholes are designed as two slotted channels positioned opposite and parallel to each other and which are arranged for acceptance of keys designed for insertion, and that the abutment units project into their separate channels.

3. A coin-operated lock as claimed in claims 1 or 2, characterized in that the fence is made as a swingable unit, the axis of rotation of which lying between the planes of the keyholes and parallel to these, the fence at its free end remote from said axis being provided with opposite projecting securing projections which, depending on the position of the fence, are arranged for a securing mesh with separate keys.

4. A coin-operated lock as claimed in claim 1, characterized in that the tumblers are arranged for both a springy securing effect on the keys in a direction opposite to their direction of insertion and for fixed securing of the keys in a direction transverse of their direction of insertion.

5. A coin-operated lock as claimed in claim 4, characterized in that the fence is made as a double-walled body, either wall of the body facing its own slot-shaped channel, that the walls are interspaced, and that the fence and tumblers are arranged so that the tumblers in blocking position bear against the inner side of the side wall, the outside of which faces a blocked keyhole.

6. A coin-operated lock as claimed in claim 1, arranged for operation by keys, one of which has the form of a coin carrier, characterized in that one of the tumblers is arranged only for interaction with a key carrying a coin.

7. A coin-operated lock as claimed in claim 3, characterized in that the stop units of the fence have the shape of projections which project from the fence to either side of the axis of fence oscillation.

8. A coin-operated lock as claimed in claim 3, characterized in that the tumblers are arranged for both a springy securing effect on the keys in a direction opposite to their direction of insertion and for fixed securing of the keys in a direction transverse of their direction of insertion.

9. A coin-operated lock as claimed in claim 3, arranged for operation by keys, one of which has the form of a coin carrier, characterized in that one of the tumblers is arranged only for interaction with a key carrying a coin.

* * * * *